US011723399B2

(12) United States Patent
Conner et al.

(10) Patent No.: US 11,723,399 B2
(45) Date of Patent: Aug. 15, 2023

(54) SMOKING ARTICLE WITH DETACHABLE CARTRIDGE

(71) Applicant: R.J. REYNOLDS TOBACCO COMPANY, Winston-Salem, NC (US)

(72) Inventors: Billy T. Conner, Clemmons, NC (US); Paul E. Braxton, Summerfield, NC (US); Stephen B. Sears, Siler City, NC (US); Karen H. Cleckley, Kernersville, NC (US); Justin William Gage, Greensboro, NC (US); Jason M. Short, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 917 days.

(21) Appl. No.: 16/035,103

(22) Filed: Jul. 13, 2018

(65) Prior Publication Data

US 2020/0015519 A1 Jan. 16, 2020

(51) Int. Cl.
*A24D 3/04* (2006.01)
*A24D 1/14* (2006.01)

(52) U.S. Cl.
CPC ..... *A24D 3/04* (2013.01); *A24D 1/14* (2013.01)

(58) Field of Classification Search
CPC . A24D 1/20; A24F 13/00; A24F 13/02; A24F 13/22; A24F 13/28; A24F 2700/00;
(Continued)

(56) References Cited

U.S. PATENT DOCUMENTS 1,464,300 A 8/1923 Taff
1,505,655 A 8/1924 Marek
(Continued)

FOREIGN PATENT DOCUMENTS

CA 2 856 321 C 4/2020
CA 2 808 836 C 5/2020
(Continued)

OTHER PUBLICATIONS

Stephenson, "A 'Safer' Cigarette? Prove It, Say Critics", JAMA, 2000, 283(19), pp. 2507-2508. doi:10.1001/jama.283.19.2507.
(Continued)

*Primary Examiner* — Kelly M Gambetta
*Assistant Examiner* — Katherine A Will
(74) *Attorney, Agent, or Firm* — Womble Bond Dickinson (US) LLP

(57) ABSTRACT

The present disclosure is directed to a smoking article that comprises a holder that includes a receiving end and a mouth end, a removable cartridge configured to be received at the receiving end of the holder, the removable cartridge comprising a heat source configured to generate heat upon ignition thereof, and a substrate portion having opposed first and second ends, the heat source being disposed proximate the first end of the substrate portion, and the substrate portion including a substrate material having an aerosol precursor composition associated therewith, and an ejection mechanism configured to move the cartridge relative to the holder between a received position and an ejected position. In one implementation, the ejection mechanism comprises a pusher pin, a guide ring, a carrier sleeve, and a spring, wherein the cartridge is configured to be received into the carrier sleeve, and wherein the pusher pin is configured to move relative to the guide ring so as to actuate the carrier sleeve alternately between the received position and the ejected position.

19 Claims, 10 Drawing Sheets

(58) Field of Classification Search
CPC .. A24F 47/004; A24F 7/00; A24F 7/02; A24F 9/00; A24F 9/14; A24F 9/16
USPC ..... 131/182
See application file for complete search history.

(56) References Cited

U.S. PATENT DOCUMENTS 1,541,891 A 6/1925 Becker
1,607,132 A 11/1926 Kuno
1,613,545 A * 1/1927 Teigen ..... A24F 13/08 131/182
1,941,531 A 1/1934 Blankenship
2,008,433 A 7/1935 Ashour
2,267,966 A * 12/1941 Allen ..... A24F 13/14 131/175
2,373,629 A 4/1945 Kilgore
2,455,492 A 12/1948 Jackson
2,502,831 A 4/1950 Daze
2,541,837 A 2/1951 Schroff
2,701,571 A 2/1955 Dittrich
2,711,176 A 6/1955 Vakilian
2,779,340 A 1/1957 Mansfield
2,953,136 A 9/1960 Dahly
3,155,099 A 11/1964 Minchin
3,181,538 A 5/1965 Piliego
3,685,520 A 8/1972 Chernack
4,708,151 A 11/1987 Shelar
4,714,082 A 12/1987 Banegee et al.
4,950,015 A * 8/1990 Nejib ..... A61M 5/3213 81/3.43
4,966,171 A 10/1990 Serrano et al.
4,991,606 A 2/1991 Serrano et al.
5,040,552 A 8/1991 Schleich et al.
5,060,676 A 10/1991 Hearn et al.
5,076,296 A 12/1991 Nystrom et al.
5,159,940 A 11/1992 Hayward et al.
5,178,165 A 1/1993 DeFelice
5,240,012 A * 8/1993 Ehrman ..... A24F 47/004 131/182
5,497,791 A * 3/1996 Bowen ..... A24F 13/00 131/175
5,592,955 A 1/1997 Keritsis
5,595,577 A 1/1997 Bensalem et al.
5,692,525 A 12/1997 Counts et al.
5,845,649 A 12/1998 Saito et al.
6,006,757 A 12/1999 Lichtenberg
6,053,176 A 4/2000 Adams et al.
6,164,287 A 12/2000 White
6,311,694 B1 11/2001 Nichols et al.
6,345,625 B1 2/2002 Chew
6,371,127 B1 4/2002 Snaidr et al.
6,431,177 B1 8/2002 Sieggen et al.
6,532,965 B1 3/2003 Abhulimen et al.
6,615,843 B2 9/2003 Pera
6,748,955 B2 6/2004 Snaidr et al.
7,080,649 B2 7/2006 Hcu
7,503,330 B2 3/2009 Borschke et al.
7,600,517 B1 10/2009 Holzrichter
7,624,739 B2 12/2009 Snaidr et al.
8,061,361 B2 11/2011 Maeder et al.
8,151,803 B2 4/2012 Inagaki
8,302,611 B2 11/2012 Rowley
8,528,567 B2 9/2013 Hajaligol
8,616,217 B2 12/2013 Tsurizumi et al.
8,776,803 B2 7/2014 Tarora et al.
8,863,754 B2 10/2014 Renaud et al.
8,915,255 B2 12/2014 Poget et al.
8,960,199 B2 * 2/2015 Zhuang ..... A24D 3/048 131/360
9,078,473 B2 7/2015 Worm et al.
9,149,072 B2 10/2015 Conner et al.
9,220,301 B2 12/2015 Banegee et al.
9,282,769 B2 3/2016 Mishra et al.
9,301,546 B2 4/2016 Thomas et al.
9,332,784 B2 5/2016 Banerjee et al.
9,439,453 B2 9/2016 Conner et al.
9,532,591 B2 1/2017 Mironov
9,549,572 B2 1/2017 Dincer et al.
9,609,893 B2 4/2017 Novak, III et al.
9,629,393 B2 4/2017 Stolz et al.
9,693,587 B2 7/2017 Plojoux
9,717,273 B2 8/2017 Poget et al.
9,730,468 B2 8/2017 Poget et al.
9,801,412 B2 10/2017 Grant
9,894,930 B2 2/2018 Bonici et al.
9,918,494 B2 3/2018 Mironov et al.
9,930,915 B2 4/2018 Worm et al.
9,943,114 B2 4/2018 Batista
9,961,939 B2 5/2018 Reevell
10,034,493 B2 7/2018 Akiyama et al.
10,064,428 B2 9/2018 Swepston et al.
10,064,478 B2 9/2018 Brooks
10,111,463 B2 10/2018 Batista
10,159,277 B2 12/2018 Bonnely
10,212,968 B2 2/2019 Mironov et al.
10,398,168 B2 9/2019 Maiwald et al.
10,470,491 B2 11/2019 Sutton et al.
10,492,526 B2 12/2019 Sampson et al.
10,524,503 B2 1/2020 Florack et al.
10,827,780 B2 11/2020 Swepston et al.
2007/0023056 A1 * 2/2007 Cantrell ..... A24B 15/165 131/194
2008/0047570 A1 2/2008 Plank
2009/0065011 A1 3/2009 Maeder et al.
2011/0083674 A1 4/2011 Karpinsky
2013/0133675 A1 5/2013 Shinozaki et al.
2013/0167850 A1 7/2013 Al-Aawar
2013/0228190 A1 9/2013 Weiss et al.
2014/0048085 A1 2/2014 Cox
2014/0060555 A1 3/2014 Chang et al.
2015/0034100 A1 2/2015 Park et al.
2015/0040924 A1 2/2015 Mironov et al.
2015/0296882 A1 10/2015 Mironov et al.
2015/0342254 A1 12/2015 Mironov et al.
2016/0007648 A1 1/2016 Sutton et al.
2016/0007649 A1 1/2016 Sampson et al.
2016/0120216 A1 5/2016 Mironov et al.
2016/0135495 A1 5/2016 Poget et al.
2016/0174609 A1 6/2016 Mironov
2016/0192704 A1 7/2016 Bonnely
2016/0316816 A1 11/2016 Lavanchy et al.
2016/0360785 A1 12/2016 Bless et al.
2017/0000189 A1 1/2017 Mironov et al.
2017/0055577 A1 3/2017 Batista
2017/0055578 A1 3/2017 Oda et al.
2017/0164654 A1 6/2017 Ademe
2017/0196261 A1 7/2017 Borges De Couraca et al.
2017/0303585 A1 10/2017 Florack et al.
2017/0318859 A1 11/2017 Batista
2018/0000165 A1 1/2018 Liu
2018/0014571 A1 1/2018 Nakano
2018/0070640 A1 3/2018 Bessant et al.
2018/0116280 A1 5/2018 Maiwald et al.
2018/0192707 A1 7/2018 Worm et al.
2018/0317560 A1 11/2018 Shinozaki et al.
2018/0325167 A1 11/2018 Grant
2018/0368468 A1 12/2018 Mishra et al.
2019/0000135 A1 1/2019 Lavanant et al.
2019/0000141 A1 1/2019 Rojo-Calderon et al.
2019/0000142 A1 1/2019 Lavanchy et al.
2019/0014818 A1 1/2019 Saygili
2019/0014820 A1 1/2019 Malgat
2019/0014821 A1 1/2019 Batista et al.
2019/0059449 A1 2/2019 Akiyama et al.
2019/0059450 A1 2/2019 Akiyama et al.
2019/0075848 A1 3/2019 Worm et al.
2019/0124972 A1 5/2019 Nakano
2019/0124973 A1 5/2019 Nakano et al.
2019/0133176 A1 5/2019 Nakano et al.
2019/0150505 A1 5/2019 Ceppi et al.
2019/0274358 A1 9/2019 Reevell
2020/0015519 A1 1/2020 Conner et al.
2020/0060333 A1 2/2020 Sutton et al.
2020/0146349 A1 5/2020 Phillips et al.

(56) References Cited

U.S. PATENT DOCUMENTS

| | | | |
|---|---|---|---|
| 2020/0268044 | A1 | 8/2020 | Wilson |
| 2021/0015172 | A1 | 1/2021 | Conner et al. |
| 2021/0015174 | A1 | 1/2021 | Cox et al. |
| 2021/0015175 | A1 | 1/2021 | Jackson et al. |

FOREIGN PATENT DOCUMENTS

| | | | |
|---|---|---|---|
| EP | 2647301 | A2 | 10/2013 |
| GB | 2511304 | A | 9/2014 |
| JP | 2002034543 | A | 2/2002 |
| JP | 2013-524850 | A | 6/2013 |
| RU | 2 647 773 | C2 | 3/2018 |
| WO | WO1995034226 | | 12/1995 |
| WO | WO1998054989 | | 12/1998 |
| WO | WO2009022232 | | 2/2009 |
| WO | 2011/139730 | A1 | 11/2011 |
| WO | WO2013072336 | | 5/2013 |
| WO | 2013083963 | A1 | 6/2013 |
| WO | WO2013149810 | | 10/2013 |
| WO | WO2013189836 | | 12/2013 |
| WO | WO2014037270 | | 3/2014 |
| WO | WO2014156838 | | 10/2014 |
| WO | 2014180893 | A1 | 11/2014 |
| WO | 2015/046072 | A1 | 4/2015 |
| WO | WO2015097005 | | 7/2015 |
| WO | WO2015128384 | | 9/2015 |
| WO | WO2015151158 | | 10/2015 |
| WO | WO2015184744 | | 12/2015 |
| WO | WO2015197850 | | 12/2015 |
| WO | 2017/004185 | A1 | 1/2017 |
| WO | WO2017042297 | | 3/2017 |
| WO | WO2017108912 | | 6/2017 |
| WO | WO2017114760 | | 7/2017 |
| WO | WO2017115181 | | 7/2017 |
| WO | WO2017115182 | | 7/2017 |
| WO | WO2017115183 | | 7/2017 |
| WO | WO2017115184 | | 7/2017 |
| WO | WO2017115185 | | 7/2017 |
| WO | WO2017115188 | | 7/2017 |
| WO | WO2017115196 | | 7/2017 |
| WO | WO2017207442 | | 12/2017 |
| WO | WO2017212284 | | 12/2017 |
| WO | 2018/019855 | A1 | 2/2018 |
| WO | WO2018170800 | | 9/2018 |
| WO | WO2018201655 | | 11/2018 |
| WO | WO2019010680 | | 1/2019 |
| WO | 2020216762 | A1 | 10/2020 |

OTHER PUBLICATIONS

"Chemical and Biological Studies on New Cigarette Prototypes That Heat Instead of Burn Tobacco", R. J. Reynolds Tobacco Company, 1988.

International Search Report from corresponding International Appl. No. PCT/IB2019/055970, dated Jan. 14, 2020.

* cited by examiner

SMOKING ARTICLE WITH DETACHABLE CARTRIDGE

FIELD OF THE DISCLOSURE

The present disclosure relates to aerosol delivery devices and systems, such as smoking articles; and more particularly, to aerosol delivery devices and systems that utilize combustible carbon-based ignition sources for the production of aerosol (e.g., smoking articles for purposes of yielding components of tobacco, tobacco extracts, nicotine, synthetic nicotine, non-nicotine flavoring, and other materials in an inhalable form, commonly referred to as heat-not-burn systems or electronic cigarettes). Components of such articles are made or derived from tobacco, or those articles can be characterized as otherwise incorporating tobacco for human consumption, and which are capable of vaporizing components of tobacco and/or other tobacco related materials to form an inhalable aerosol for human consumption.

BACKGROUND

Many smoking articles have been proposed through the years as improvements upon, or alternatives to, smoking products based upon combusting tobacco. Example alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0220232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety. Other representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Pat. App. Pub. No. 2009/0095311 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon, which are incorporated herein by reference.

Various manners and methods for assembling smoking articles that possess a plurality of sequentially arranged segmented components have been proposed. See, for example, the various types of assembly techniques and methodologies set forth in U.S. Pat. No. 5,469,871 to Barnes et al. and U.S. Pat. No. 7,647,932 to Crooks et al.; and U.S. Pat. App. Pub. Nos. 2010/0186757 to Crooks et al.; 2012/0042885 to Stone et al., and 2012/00673620 to Conner et al.; each of which is incorporated by reference herein in its entirety.

Representative products that resemble many of the attributes of traditional types of cigarettes, cigars or pipes have been marketed as ACCORD® by Philip Morris Incorporated; ALPHA™, JOYE 510™ and M4™ by InnoVapor LLC; CIRRUS™ and FLING™ by White Cloud Cigarettes; BLU™ by Fontem Ventures B.V.; COHITA™, COLIBRI™, ELITE CLASSIC™, MAGNUM™, PHANTOM™ and SENSE™ by EPUFFER® International Inc.; DUOPRO™, STORM™ and VAPORKING® by Electronic Cigarettes, Inc.; EGAR™ by Egar Australia; eGo-C™ and eGo-T™ by Joyetech; ELUSION™ by Elusion UK Ltd; EONSMOKE® by Eonsmoke LLC; FIN™ by FIN Branding Group, LLC; SMOKE® by Green Smoke Inc. USA; GREENARETTE™ by Greenarette LLC; HALLIGAN™ HENDU™ JET™, MAXXQ™, PINK™ and PITBULL™ by SMOKE STIK®; HEATBAR™ by Philip Morris International, Inc.; HYDRO IMPERIAL™ and LXE™ from Crown7; LOGIC™ and THE CUBAN™ by LOGIC Technology; LUCI® by Luciano Smokes Inc.; METRO® by Nicotek, LLC; NJOY® and ONEJOY™ by Sottera, Inc.; NO. 7™ by SS Choice LLC; PREMIUM ELECTRONIC CIGARETTE™ by PremiumEstore LLC; RAPP E-MYSTICK™ by Ruyan America, Inc.; RED DRAGON™ by Red Dragon Products, LLC; RUYAN® by Ruyan Group (Holdings) Ltd.; SF® by Smoker Friendly International, LLC; GREEN SMART SMOKER® by The Smart Smoking Electronic Cigarette Company Ltd.; SMOKE ASSIST® by Coastline Products LLC; SMOKING EVERYWHERE® by Smoking Everywhere, Inc.; V2CIGS™ by VMR Products LLC; VAPOR NINE™ by VaporNine LLC; VAPOR4LIFE® by Vapor 4 Life, Inc.; VEPPO™ by E-CigaretteDirect, LLC; VUSE® by R. J. Reynolds Vapor Company; Mistic Menthol product by Mistic Ecigs; and the Vype product by CN Creative Ltd.; IQOS™ by Philip Morris International; and GLO™ by British American Tobacco. Yet other electrically powered aerosol delivery devices, and in particular those devices that have been characterized as so-called electronic cigarettes, have been marketed under the tradenames COOLER VISIONS™; DIRECT E-CIG™; DRAGONFLY™; EMIST™; EVERSMOKE™; GAMUCCI®; HYBRID FLAME™; KNIGHT STICKS™; ROYAL BLUES™; SMOKETIP®; and SOUTH BEACH SMOKE™.

In some instances, traditional types of smoking articles, such as those referenced above, are difficult to assemble as a result of multiple components that must be disassembled and reassembled upon consumption of aerosol delivery components provided therein. In some other instances, some smoking articles, particularly those that employ a traditional paper wrapping material, are also prone to scorching of the paper wrapping material overlying an ignitable fuel source, due to the high temperature attained by the fuel source in proximity to the paper wrapping material. This can reduce enjoyment of the smoking experience for some consumers and can mask or undesirably alter the flavors delivered to the consumer by the aerosol delivery components of the smoking articles. In further instances, traditional types of smoking articles can produce relatively significant levels of gasses, such as carbon monoxide and/or carbon dioxide, during use (e.g., as products of carbon combustion). In still further instances, traditional types of smoking articles may suffer from poor performance with respect to aerosolizing the aerosol forming component(s).

As such, it would be desirable to provide smoking articles that address one or more of the technical problems sometimes associated with traditional types of smoking articles. In particular, it would be desirable to provide a smoking article that is easy to use and that provides reusable components.

BRIEF SUMMARY

In various implementations, the present disclosure provides a smoking article. In one implementation, the smoking article may comprise a holder that includes a receiving end and a mouth end, a removable cartridge configured to be received into the receiving end of the holder, the removable cartridge comprising a heat source configured to generate heat upon ignition thereof, and a substrate portion having opposed first and second ends, the heat source being disposed proximate the first end of the substrate portion, and the substrate portion including a substrate material having an aerosol precursor composition associated therewith, and an ejection mechanism configured to move the cartridge relative to the holder between a received position and an ejected position. In some implementations, the cartridge may further comprise an outer housing configured to circumscribe at least a portion of the substrate portion. In some implementations, the outer housing may include one or more end apertures configured to allow aerosol from the substrate material to pass therethrough. In some implementations, the ejection mechanism may comprise a pusher pin, a guide ring, a carrier sleeve, and a spring, and the cartridge may be configured to be received into the carrier sleeve, and the pusher pin may be configured to move the carrier sleeve relative to the guide ring so as to actuate the carrier sleeve alternately between the received position and the ejected position. In some implementations, the carrier sleeve may include a vapor passageway and the pusher pin may include an inside bore, and the vapor passageway and the inside bore may be configured to provide a path for aerosol from the substrate material to pass therethrough. In some implementations, the substrate material may comprise at least one of tobacco-containing beads, tobacco shreds, tobacco strips, pieces of a reconstituted tobacco material, tobacco rods, and non-tobacco materials. In some implementations, the substrate material may comprise a non-tobacco material.

In some implementations, the heat source may comprise an extruded monolithic carbonaceous material. In some implementations, the heat source may define one or more passages extending longitudinally from a first end of the heat source to an opposing second end of the heat source. In some implementations, the heat source may define one or more peripheral grooves extending longitudinally from a first end of the heat source to an opposing second end of the heat source. In some implementations, the holder may comprise a main body portion and a mouthpiece at the mouth end of the holder, and the mouthpiece may be configured to move relative to the main body portion. In some implementations, the holder may include a plurality of openings located proximate the receiving end. In some implementations, the holder may be constructed of at least one of a ceramic material, a plastic material, and a metal material. In some implementations, the holder may include a thermal indicator configured to indicate a status of the cartridge. In some implementations, the substrate material may comprise first and second substrate material segments and the second substrate material segment may be disposed proximate a second end of the first substrate material segment. In some implementations, the second substrate material segment may comprise at least one of tobacco-containing beads, tobacco shreds, tobacco strips, pieces of a reconstituted tobacco material, or tobacco rods. In some implementations, the second substrate material segment may comprise a non-tobacco material. In some implementations, the mouthpiece may include a filter. In some implementations, the cartridge may include one or more retaining features configured to retain the cartridge once inserted into the holder. In some implementations, the holder may include one or more complementary retaining features.

In various implementations, the present disclosure also provides a removable cartridge for use with a smoking article. In one implementation, the removable cartridge may comprise a heat source configured to generate heat upon ignition thereof, a substrate portion having opposed first and second ends, the heat source being disposed proximate the first end of the substrate portion, and the substrate portion including a substrate material having an aerosol precursor composition associated therewith, and an outer housing configured to circumscribe at least a portion of the heat source and the substrate portion. The outer housing may comprise an open end and a closed end, and the closed end may include one or more end apertures configured to allow aerosol from the substrate material to pass therethrough. In some implementations, the substrate material may comprise at least one of tobacco-containing beads, tobacco shreds, tobacco strips, pieces of a reconstituted tobacco material, tobacco rods, and non-tobacco materials. In some implementations, the substrate material may comprise a non-tobacco material. In some implementations, the heat source may comprise an extruded monolithic carbonaceous material. In some implementations, the heat source may define one or more passages extending longitudinally from a first end of the heat source to an opposing second end of the heat source. In some implementations, the heat source may define one or more peripheral grooves extending longitudinally from a first end of the heat source to an opposing second end of the heat source. In some implementations, the substrate material may comprise first and second substrate material segments and the second substrate material segment may be disposed proximate a second end of the first substrate material. In some implementations, the second substrate material segment may comprise at least one of tobacco-containing beads, tobacco shreds, tobacco strips, pieces of a reconstituted tobacco material, or tobacco rods. In some implementations, the second substrate material segment may comprise a non-tobacco material. In some implementations, the apertures may comprise a pair of elongate rounded slots.

These and other features, aspects, and advantages of the disclosure will be apparent from a reading of the following detailed description together with the accompanying drawings, which are briefly described below.

BRIEF DESCRIPTION OF THE DRAWINGS

Figure 1:
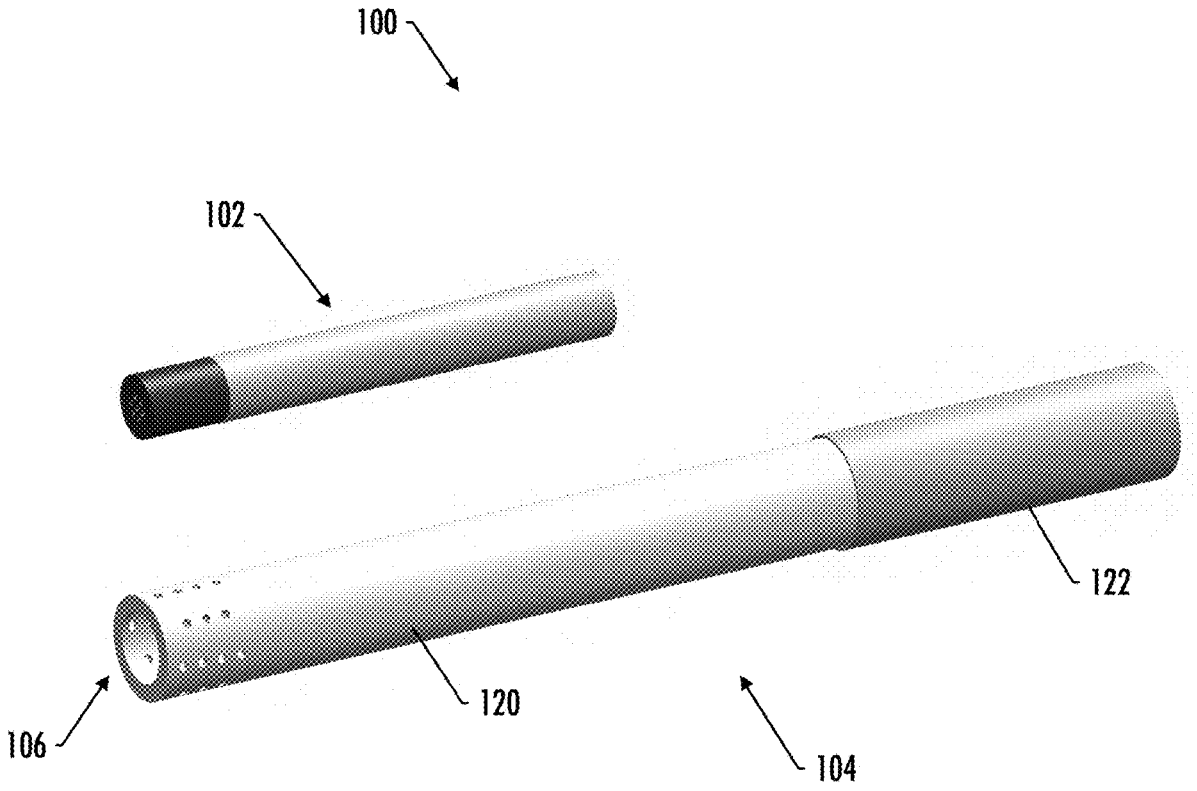
Figure 2:
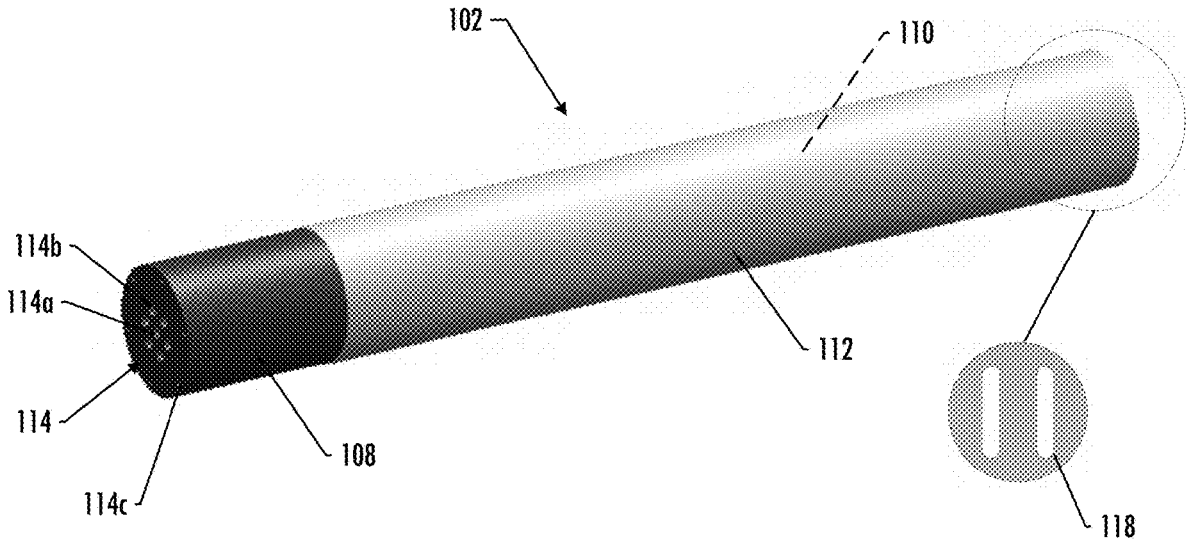
Figure 3:
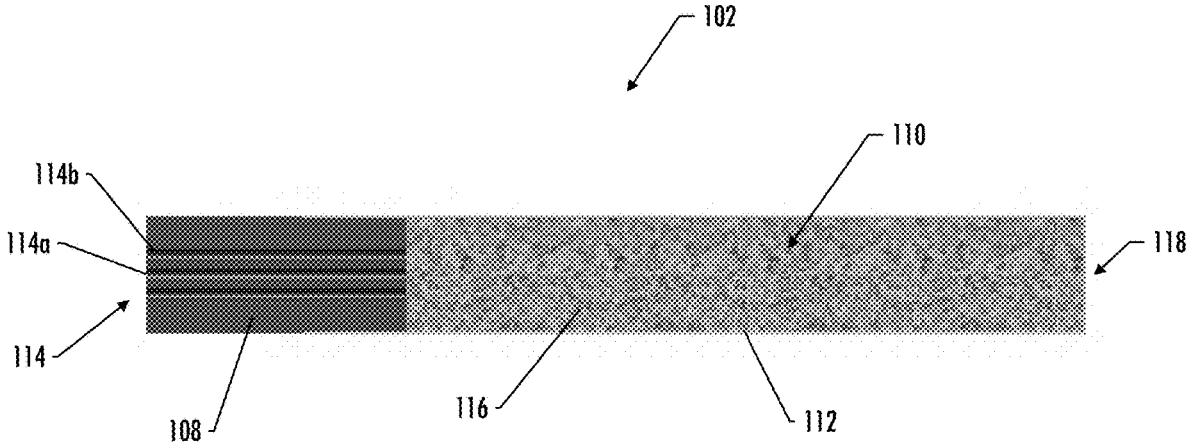
Figure 4:
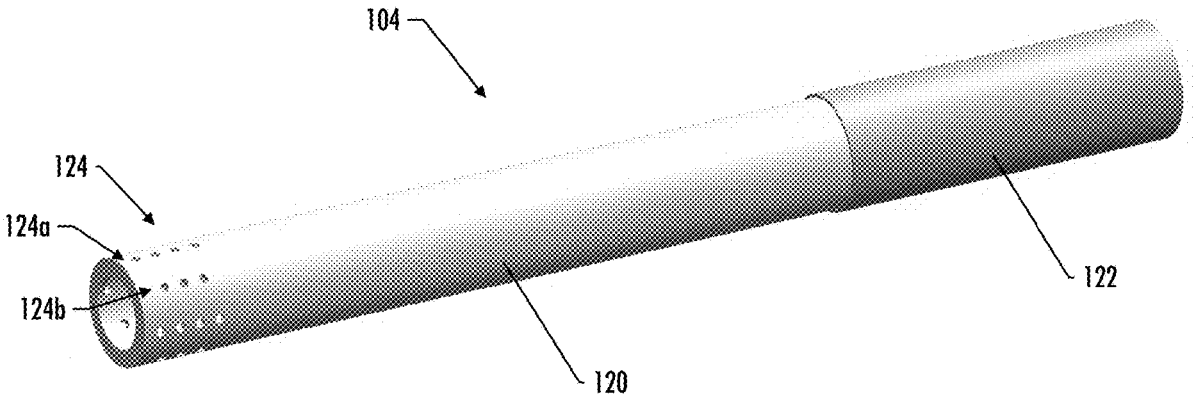
Figure 5:
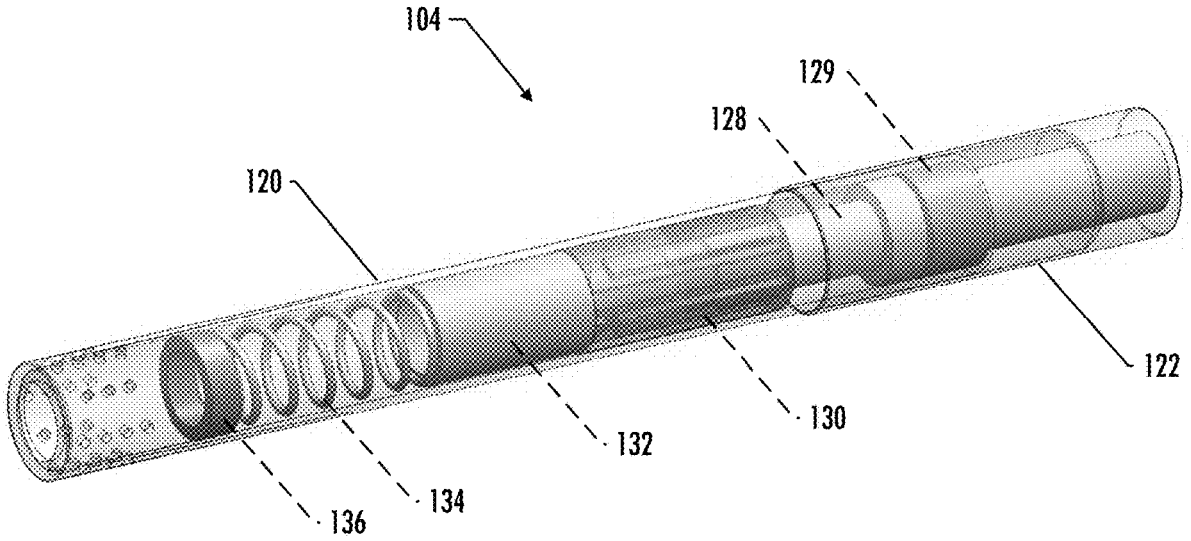
Figure 6:
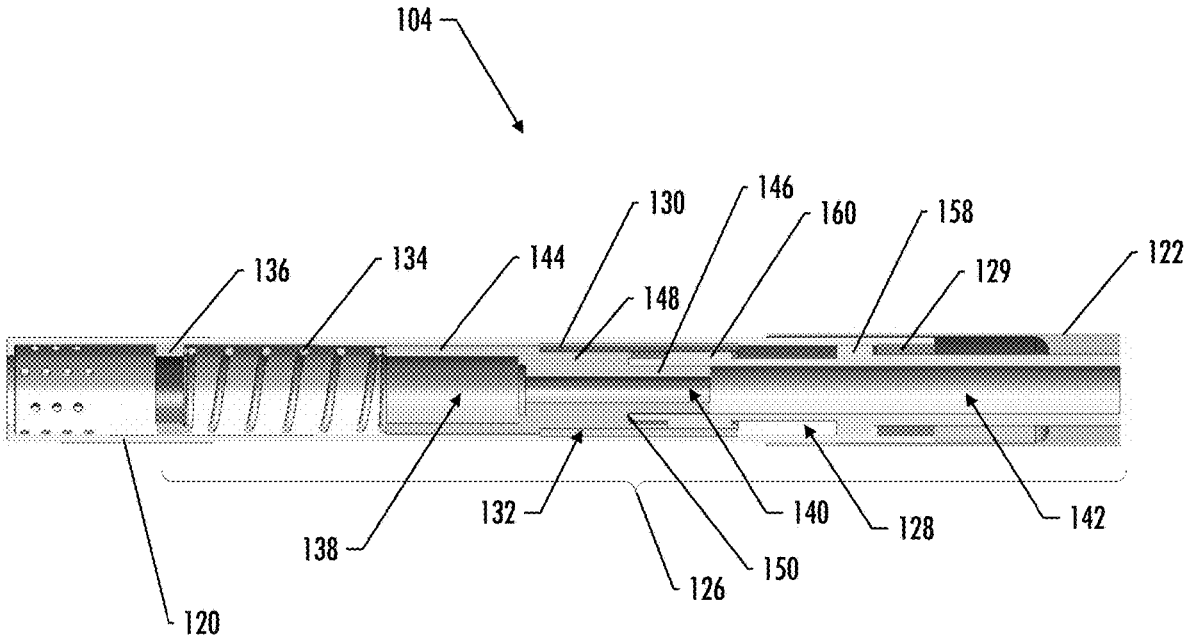
Figure 7:
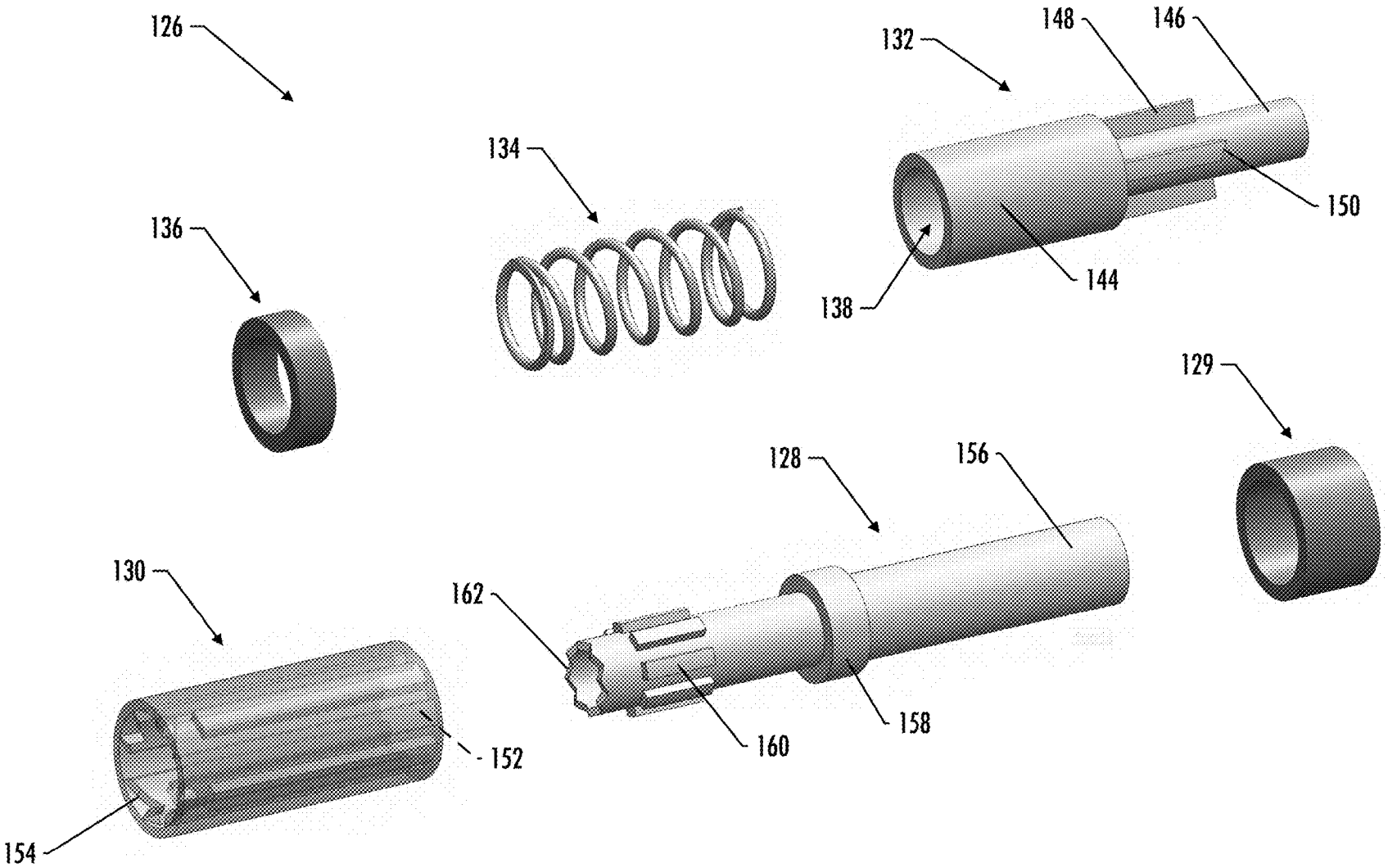
Figure 8:
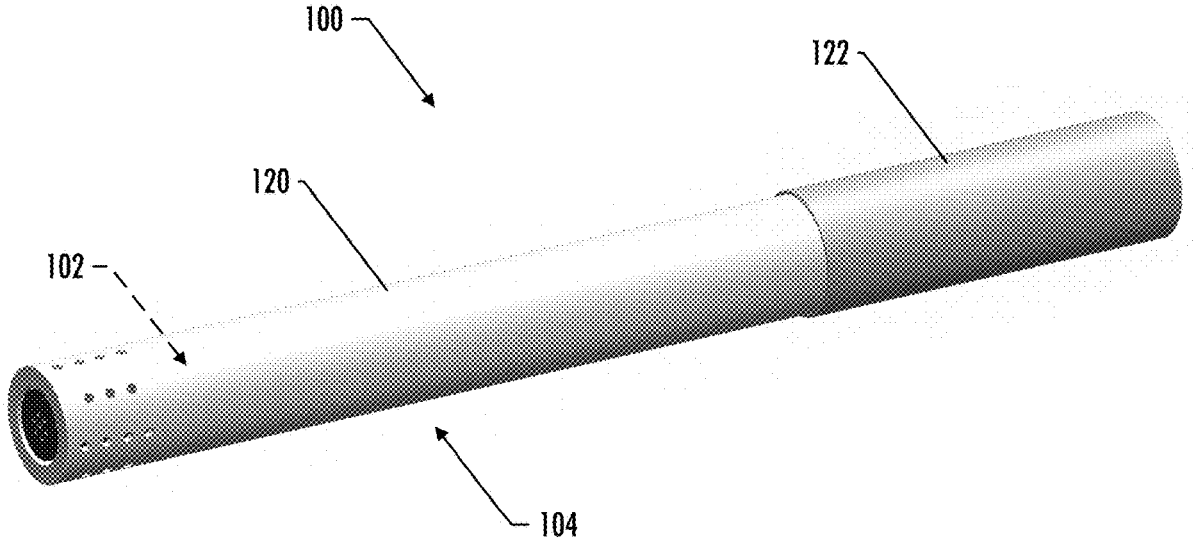
Figure 9:
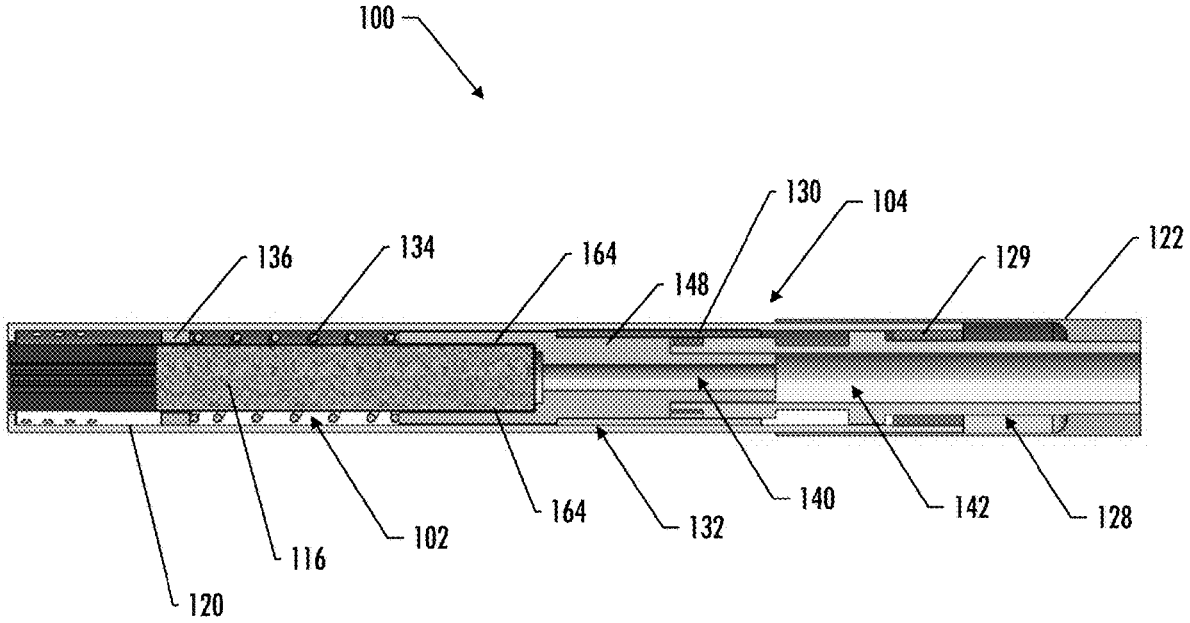
Figure 10:
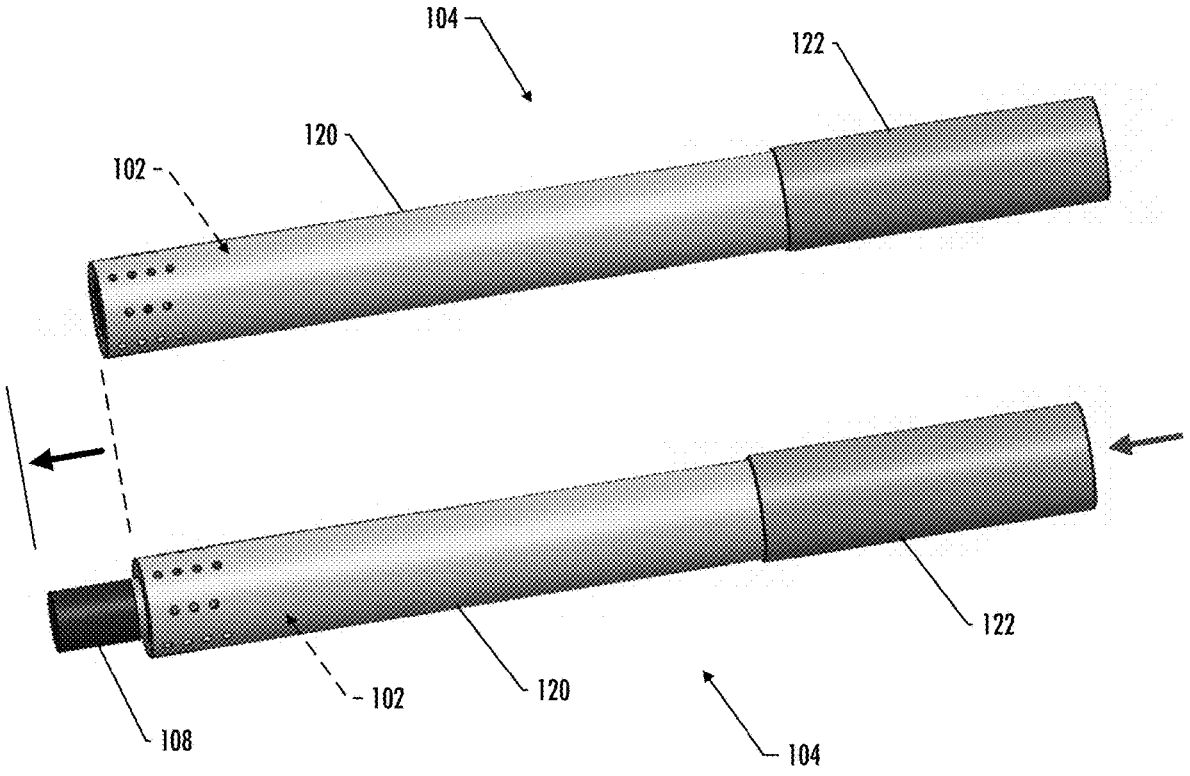

Having thus described the disclosure in the foregoing general terms, reference will now be made to the accompanying drawings, which are not necessarily drawn to scale, and wherein:

FIG. 1 illustrates a perspective view of a smoking article that includes a holder and a detachable cartridge, according to one implementation of the present disclosure;

FIG. 2 illustrates a perspective view of a cartridge, according to one implementation of the present disclosure;

FIG. 3 illustrates a longitudinal cross-section view of a cartridge, according to one implementation of the present disclosure;

FIG. 4 illustrates a perspective view of a holder, according to one implementation of the present disclosure;

FIG. 5 illustrates a perspective view of a holder showing various internal components, according to one implementation of the present disclosure;

FIG. 6 illustrates a longitudinal cross-section view of a holder, according to one implementation of the present disclosure;

FIG. 7 illustrates perspective views of various components of an ejection mechanism, according to one implementation of the present disclosure;

FIG. 8 illustrates a perspective view of a smoking article, with a removable cartridge received into a holder in a received position, according to one implementation of the present disclosure;

FIG. 9 illustrates a longitudinal cross-section view of a smoking article, with the cartridge received into the holder in a received position, according to one implementation of the present disclosure; and FIG. 10 illustrates a perspective view of a smoking article, showing a received position of the cartridge and an ejected position of the cartridge, according to one implementation of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure is embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides descriptions of articles (and the assembly and/or manufacture thereof) in which a material is heated (preferably without combusting the material to any significant degree) to form an aerosol and/or an inhalable substance; such articles most preferably being sufficiently compact to be considered "hand-held" devices. In preferred aspects, the articles are characterized as smoking articles. As used herein, the term "smoking article" is intended to mean an article and/or device that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article and/or device. As used herein, the term "smoking article" does not necessarily mean that, in operation, the article or device produces smoke in the sense of an aerosol resulting from by-products of combustion or pyrolysis of tobacco, but rather, that the article or device yields vapors (including vapors within aerosols that are considered to be visible aerosols that might be considered to be described as smoke-like) resulting from volatilization or vaporization of certain components, elements, and/or the like of the article and/or device. In preferred aspects, articles or devices characterized as smoking articles incorporate tobacco and/or components derived from tobacco.

As noted, aerosol generating components of certain preferred aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol delivery device in accordance with some example implementations of the present disclosure can hold and use that component much like a smoker employs a traditional type of smoking article, draw on one end of that piece for inhalation of aerosol produced by that piece, take or draw puffs at selected intervals of time, and the like.

Articles or devices of the present disclosure are also characterized as being vapor-producing articles, aerosol delivery articles, or medicament delivery articles. Thus, such articles or devices are adaptable so as to provide one or more substances in an inhalable form or state. For example, inhalable substances are substantially in the form of a vapor (e.g., a substance that is in the gas phase at a temperature lower than its critical point). Alternatively, inhalable substances are in the form of an aerosol (e.g., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like. In some implementations, the terms "vapor" and "aerosol" may be interchangeable. Thus, for simplicity, the terms "vapor" and "aerosol" as used to describe the disclosure are understood to be interchangeable unless stated otherwise.

In use, smoking articles of the present disclosure are subjected to many of the physical actions of an individual in using a traditional type of smoking article (e.g., a cigarette, cigar, or pipe that is employed by lighting with a flame and used by inhaling tobacco that is subsequently burned and/or combusted). For example, the user of a smoking article of the present disclosure holds that article much like a traditional type of smoking article, draws on one end of that article for inhalation of an aerosol produced by that article, and takes puffs at selected intervals of time.

While the systems are generally described herein in terms of implementations associated with smoking articles such as so-called "e-cigarettes" or "tobacco heating products," it should be understood that the mechanisms, components, features, and methods may be embodied in many different forms and associated with a variety of articles. For example, the description provided herein may be employed in conjunction with implementations of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of implementations relating to aerosol delivery devices by way of example only, and may be embodied and used in various other products and methods.

Smoking articles of the present disclosure generally include a number of elements provided or contained within an enclosure of some sort, such as a housing, an outer wrap, or wrapping, a casing, a component, a module, a member, or the like. The overall design of the enclosure is variable, and the format or configuration of the enclosure that defines the overall size and shape of the smoking article is also variable. It is desirable, in some aspects, that the overall design, size, and/or shape of the enclosure resembles that of a conventional cigarette or cigar. Typically, an enclosure resembling the shape of a cigarette or cigar comprises separable components, members, or the like that are engaged to form the enclosure. For example, such a smoking article may comprise, in some aspects, three separable components that include a mouthpiece component, an aerosol delivery component (such as, for example, a substrate material), and a heat source component. In various aspects, the heat source may be capable of generating heat to aerosolize a substrate material that comprises, for example, an extruded structure and/or substrate, a substrate material associated with an aerosol precursor composition, tobacco and/or a tobacco related material, such as a material that is found naturally in tobacco that is isolated directly from the tobacco or synthetically prepared, in a solid or liquid form (e.g., beads, sheets, shreds, a wrap), or the like. In some implementations, an extruded structure may comprise tobacco products or a composite of tobacco with other materials such as, for example, ceramic powder. In other implementations, a tobacco extract/slurry may be loaded into porous ceramic beads. Other implementations may use non-tobacco products. In some implementations e-liquid-loaded porous beads/powders (ceramics) may be used. In other implementations, rods/cylinders made of extruded slurry of ceramic powder and e-liquid may be used.

According to certain aspects of the present disclosure, it may be advantageous to provide a smoking article that is easy to use and that provides reusable components. FIG. 1 illustrates a perspective view of such a smoking article, according to one implementation of the present disclosure. In particular, FIG. 1 illustrates a perspective view of a smoking article 100 that includes a removable cartridge 102 and a holder 104. The holder 104 includes a main body portion 120 and a mouthpiece 122 located at a mouth end of the holder 104. As will be discussed in more detail below, in the depicted implementation the removable cartridge 102 is configured to be received into a cavity 106 defined on a receiving end of the main body portion 120 of the holder 104. FIG. 2 illustrates a perspective view of the removable cartridge 102 of FIG. 1. In the depicted implementation, the removable cartridge 102 includes a heat source 108, a substrate portion 110, and an outer housing 112 that is configured to circumscribe at least a portion of the heat source 108 and substrate portion 110.

It should be noted that although in the depicted implementation the cartridge 102 and the holder 104 have substantially cylindrical shapes that imitate the shape of a traditional cigarette, in various other implementations, any one or both of these components (and/or any of their subcomponents, such as, for example, the main body portion 120, the mouthpiece 122, or the ejection mechanism 126 of the holder 104, and/or the heat source 108, the outer housing 112, or the substrate material 116 of the cartridge 102) may have a different shape. For example, in some implementations one or both of the holder 104 or the cartridge 102 (and/or any of their subcomponents) may have a substantially rectangular shape, such as a substantially rectangular cuboid shape (e.g., similar to a USB flash drive). In other implementations, one or both of the holder 104 or the cartridge 102 (and/or any of their subcomponents) may have other hand-held shapes. For example, in some implementations the holder 104 may have a small box shape, various pod mod shapes, or a fob-shape.

In various implementations, the heat source 108 may be configured to generate heat upon ignition thereof. In the depicted implementation, the heat source 108 comprises a combustible fuel element that has a generally cylindrical shape and that incorporates a combustible carbonaceous material. In other implementations, the heat source 108 may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source 108 may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). Although specific dimensions of an applicable heat source may vary, in the depicted implementation, the heat source 108 has a length in an inclusive range of approximately 5 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm). Although in other implementations, the heat source may be constructed in a variety of ways, in the depicted implementation, the heat source 108 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Although in various implementations the heat source may have a variety of forms, including, for example, a substantially solid cylindrical shape or a hollow cylindrical (e.g., tube) shape, the heat source 108 of the depicted implementation comprises an extruded monolithic carbonaceous material that has a generally cylindrical shape that includes a plurality of internal passages 114 extending longitudinally from a first end of the heat source 108 to an opposing second end of the heat source 108. In the depicted implementation there are approximately thirteen internal passages 114 comprising a single central internal passage 114*a*, six surrounding internal passages 114*b*, which are spaced from the central internal passages 114*a* and have a similar size (e.g., diameter) to that of the central internal passage 114*a*, and six peripheral internal passages 114*c*, which are spaced from an outer surface of the heat source 108 and are smaller in diameter than that of the central internal passage 114*a*. It should be noted that in other implementations, there need not be a plurality of internal passages and/or the plurality of internal passages may take other forms and/or sizes. For example, in some implementations, there may be as few as two internal passages, and still other implementations may include as few as a single internal passage. Still other implementations may include no internal passages at all. Additional implementations may include multiple internal passages that may be of unequal diameter and/or shape and which may be unequally spaced and/or located within the heat source.

Although not depicted in the figures, some implementations may alternatively, or additionally, include one or more peripheral grooves that extend longitudinally from a first end of the heat source to an opposing second end. In some implementations, such grooves may be substantially equal in width and depth and may be substantially equally distributed about a circumference of the heat source. In such implementations, there may be as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 3 illustrates a longitudinal cross-section view of the cartridge 102 of FIG. 1. As shown in the figure, the substrate portion 110 has opposed first and second ends, with the heat source 108 disposed proximate the first end of the substrate portion 110. Although dimensions of the various components of the cartridge 102 may vary due to the needs of a particular application, in the depicted implementation the cartridge 102 may an overall length in an inclusive range of approximately 10 mm to approximately 50 mm and a diameter in an inclusive range of approximately 3 mm to approximately 10 mm. In addition, in the depicted implementation the housing 112 may have a thickness in the inclusive range of approximately 0.05 mm to 0.5 mm. Furthermore, in the depicted implementation the substrate portion 110 may have a length in the inclusive range of approximately 5 mm to 30 mm and a diameter slightly less than that of the overall cartridge in order to accommodate the thickness of the housing 112, such as, for example, a diameter in an inclusive range of approximately 2.9 mm to approximately 9.9 mm.

In the depicted implementation, the substrate portion 110 comprises a substrate material 116 having a single segment, although in other implementations the substrate portion 110 may include one or more additional substrate material segments. For example in some implementations, the smoking article 100 may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 116 of the depicted implementation).

Referring also to FIG. 1, in various implementations ignition of the heat source 108 results in aerosolization of the aerosol precursor composition associated with the substrate material 116. In various implementations, the mouthpiece 122 is configured to receive the generated aerosol therethrough in response to a draw applied to the mouthpiece 122 by a user. As will be discussed in more detail below, in some implementations the mouthpiece 122 may comprise a filter configured to receive the aerosol therethrough in response to the draw applied to the mouthpiece 122. In various implementations, the filter is provided, in some aspects, as a circular disc radially and/or longitudinally disposed proximate the end of the holder 104 opposite the receiving end. In this manner, upon a draw on the mouthpiece 122, the filter receives the aerosol flowing through holder 104 of the smoking article 100. Preferably, the elements of the substrate material 116 do not experience thermal decomposition (e.g., charring, scorching, or burning) to any significant degree, and the aerosolized components are entrained in the air that is drawn through the smoking article 100, including a filter (if present), and into the mouth of the user. In the smoking article 100 of the depicted implementation, the substrate material 116 comprises a plurality of tobacco beads formed into a substantially cylindrical portion. In some implementations, the filter may comprise discrete segments. For example, some implementations may include a segment providing filtering, a segment providing draw resistance, a hollow segment providing a space for the aerosol to cool, other filter segments, and any one or any combination of the above.

In one implementation, the substrate material may comprise a blend of flavorful and aromatic tobaccos in cut filler form. In another implementation, the substrate material may comprise a reconstituted tobacco material, such as described in U.S. Pat. No. 4,807,809 to Pryor et al.; U.S. Pat. No. 4,889,143 to Pryor et al. and U.S. Pat. No. 5,025,814 to Raker, the disclosures of which are incorporated herein by reference in their entirety. Additionally, a reconstituted tobacco material may include a reconstituted tobacco paper for the type of cigarettes described in Chemical and Biological Studies on New Cigarette Prototypes that Heat Instead of Burn Tobacco, R. J. Reynolds Tobacco Company Monograph (1988), the contents of which are incorporated herein by reference in its entirety. For example, a reconstituted tobacco material may include a sheet-like material containing tobacco and/or tobacco-related materials. As such, in some implementations, the substrate material may be formed from a wound roll of a reconstituted tobacco material. In another implementation, the substrate material may be formed from shreds, strips, and/or the like of a reconstituted tobacco material. In another implementation, the tobacco sheet may comprise overlapping layers (e.g., a gathered web), which may, or may not, include heat conducting constituents. Examples of substrate portions that include a series of overlapping layers (e.g., gathered webs) of an initial substrate sheet formed by the fibrous filler material, aerosol forming material, and plurality of heat conducting constituents are described in U.S. patent application Ser. No. 15/905,320, filed on Feb. 26, 2018, and titled Heat Conducting Substrate For Electrically Heated Aerosol Delivery Device, which is incorporated herein by reference in its entirety.

In some implementations, the substrate material may include a plurality of microcapsules, beads, granules, and/or the like having a tobacco-related material. For example, a representative microcapsule may be generally spherical in shape, and may have an outer cover or shell that contains a liquid center region of a tobacco-derived extract and/or the like. In some implementations, one or more of the substrate materials may include a plurality of microcapsules each formed into a hollow cylindrical shape. In some implementations, one or more of the substrate materials may include a binder material configured to maintain the structural shape and/or integrity of the plurality of microcapsules formed into the hollow cylindrical shape.

Tobacco employed in one or more of the substrate materials may include, or may be derived from, tobaccos such as flue-cured tobacco, burley tobacco, Oriental tobacco, Maryland tobacco, dark tobacco, dark-fired tobacco and *Rustica* tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al.; U.S. Pat. No. 7,011,096 to Li et al.; U.S. Pat. No. 7,017,585 to Li et al.; U.S. Pat. No. 7,025,066 to Lawson et al.; U.S. Pat. App. Pub. No. 2004/0255965 to Perfetti et al.; PCT Pub. No. WO 02/37990 to Bereman; and Bombick et al., *Fund. Appl. Toxicol.,* 39, p. 11-17 (1997); the disclosures of which are incorporated herein by reference in their entireties.

In still other implementations of the present disclosure, the substrate material may include an extruded structure that includes, or is essentially comprised of a tobacco, a tobacco related material, glycerin, water, and/or a binder material, although certain formulations may exclude the binder material. In various implementations, suitable binder materials may include alginates, such as ammonium alginate, propylene glycol alginate, potassium alginate, and sodium alginate. Alginates, and particularly high viscosity alginates, may be employed in conjunction with controlled levels of free calcium ions. Other suitable binder materials include hydroxypropylcellulose such as Klucel H from Aqualon Co.; hydroxypropylmethylcellulose such as Methocel K4MS from The Dow Chemical Co.; hydroxyethylcellulose such as Natrosol 250 MRCS from Aqualon Co.; microcrystalline cellulose such as Avicel from FMC; methylcellulose such as Methocel A4M from The Dow Chemical Co.; and sodium carboxymethyl cellulose such as CMC 7HF and CMC 7H4F from Hercules Inc. Still other possible binder materials include starches (e.g., corn starch), guar gum, carrageenan, locust bean gum, pectins and xanthan gum. In some implementations, combinations or blends of two or more binder materials may be employed. Other examples of binder materials are described, for example, in U.S. Pat. No. 5,101,839 to Jakob et al.; and U.S. Pat. No. 4,924,887 to Raker et al., each of which is incorporated herein by reference in its entirety. In some implementations, the aerosol forming material may be provided as a portion of the binder material (e.g., propylene glycol alginate). In addition, in some implementations, the binder material may comprise nanocellulose derived from a tobacco or other biomass.

In some implementations, the substrate material may include an extruded material, as described in U.S. Pat. App. Pub. No. 2012/0042885 to Stone et al., which is incorporated herein by reference in its entirety. In yet another implementation, the substrate material may include an extruded structure and/or substrate formed from marumarized and/or non-marumarized tobacco. Marumarized tobacco is known, for example, from U.S. Pat. No. 5,105,831 to Banerjee, et al., which is incorporated by reference herein in its entirety. Marumarized tobacco includes about 20 to about 50 percent (by weight) tobacco blend in powder form, with glycerol (at about 20 to about 30 percent weight), calcium carbonate (generally at about 10 to about 60 percent by weight, often at about 40 to about 60 percent by weight), along with binder agents, as described herein, and/or flavoring agents. In various implementations, the extruded material may have one or more longitudinal openings.

In various implementations, the substrate material may take on a variety of conformations based upon the various amounts of materials utilized therein. For example, a sample substrate material may comprise up to approximately 98% by weight, up to approximately 95% by weight, or up to approximately 90% by weight of a tobacco and/or tobacco related material. A sample substrate material may also comprise up to approximately 25% by weight, approximately 20% by weight, or approximately 15% by weight water—particularly approximately 2% to approximately 25%, approximately 5% to approximately 20%, or approximately 7% to approximately 15% by weight water. Flavors and the like (which include, for example, medicaments, such as nicotine) may comprise up to approximately 10%, up to about 8%, or up to about 5% by weight of the aerosol delivery component.

Additionally or alternatively, the substrate material may include an extruded structure and/or a substrate that includes or essentially is comprised of tobacco, glycerin, water, and/or binder material, and is further configured to substantially maintain its structure throughout the aerosol-generating process. That is, the substrate material may be configured to substantially maintain its shape (e.g., the substrate material does not continually deform under an applied shear stress) throughout the aerosol-generating process. Although such an example substrate material may include liquids and/or some moisture content, the substrate may remain substantially solid throughout the aerosol-generating process and may substantially maintain structural integrity throughout the aerosol-generating process. Example tobacco and/or tobacco related materials suitable for a substantially solid substrate material are described in U.S. Pat. App. Pub. No. 2015/0157052 to Ademe et al.; U.S. Pat. App. Pub. No. 2015/0335070 to Sears et al.; U.S. Pat. No. 6,204,287 to White; and U.S. Pat. No. 5,060,676 to Hearn et al., which are incorporated herein by reference in their entirety.

In some implementations, the amount of substrate material that is used within the smoking article may be such that the article exhibits acceptable sensory and organoleptic properties, and desirable performance characteristics. For example, in some implementations an aerosol precursor composition such as, for example, glycerin and/or propylene glycol, may be employed within the substrate material in order to provide for the generation of a visible mainstream aerosol that in many regards resembles the appearance of tobacco smoke. For example, the amount of aerosol precursor composition incorporated into the substrate material of the smoking article may be in the range of about 3.5 grams or less, about 3 grams or less, about 2.5 grams or less, about 2 grams or less, about 1.5 grams or less, about 1 gram or less, or about 0.5 gram or less.

According to another implementation, a smoking article according to the present disclosure may include a substrate material comprising a porous, inert material such as, for example, a ceramic material. For example, in some implementations ceramics of various shapes and geometries (e.g., beads, rods, tubes, etc.) may be used, which have various pore morphology. In addition, in some implementations non-tobacco materials, such as e-liquids, may be loaded into the ceramics. In another implementation, the substrate material may include a porous, inert material that does not substantially react, chemically and/or physically, with a tobacco-related material such as, for example, a tobacco-derived extract. In addition, an extruded tobacco, such as those described above, may be porous. For example, in some implementations an extruded tobacco material may have an inert gas, such as, for example, nitrogen, that acts as a blowing agent during the extrusion process.

As noted above, in various implementations one or more of the substrate materials may include a tobacco, a tobacco component, and/or a tobacco-derived material that has been treated, manufactured, produced, and/or processed to incorporate an aerosol precursor composition (e.g., humectants such as, for example, propylene glycol, glycerin, and/or the like) and/or at least one flavoring agent, as well as a flame/burn retardant (e.g., diammonium phosphate and/or another salt) configured to help prevent ignition, pyrolysis, combustion, and/or scorching of the substrate material by the heat source. Various manners and methods for incorporating tobacco into smoking articles, and particularly smoking articles that are designed so as to not purposefully burn virtually all of the tobacco within those smoking articles are set forth in U.S. Pat. No. 4,947,874 to Brooks et al.; U.S. Pat. No. 7,647,932 to Cantrell et al.; U.S. Pat. No. 8,079,371 to Robinson et al.; U.S. Pat. No. 7,290,549 to Banerjee et al.; and U.S. Pat. App. Pub. No. 2007/0215167 to Crooks et al.; the disclosures of which are incorporated herein by reference in their entireties.

As noted, in some implementations, flame/burn retardant materials and other additives that may be included within one or more of the substrate materials and may include organo-phosophorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium borate, ethanolammonium borate, ammonium sulphamate, halogenated organic compounds, thiourea, and antimony oxides are suitable but are not preferred agents. In each aspect of flame-retardant, burn-retardant, and/or scorch-retardant materials used in the substrate material and/or other components (whether alone or in combination with each other and/or other materials), the desirable properties most preferably are provided without undesirable off-gassing or melting-type behavior.

According to other implementations of the present disclosure, the substrate material may also incorporate tobacco additives of the type that are traditionally used for the manufacture of tobacco products. Those additives may include the types of materials used to enhance the flavor and aroma of tobaccos used for the production of cigars, cigarettes, pipes, and the like. For example, those additives may include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Preferred casing materials may include water, sugars and syrups (e.g., sucrose, glucose and high fructose corn syrup), humectants (e.g. glycerin or propylene glycol), and flavoring agents (e.g., cocoa and licorice). Those added components may also include top dressing materials (e.g., flavoring materials, such as menthol). See, for example, U.S. Pat. No. 4,449,541 to Mays et al., the disclosure of which is incorporated herein by reference in its entirety. Further materials that may be added include those disclosed in U.S. Pat. No. 4,830,028 to Lawson et al. and U.S. Pat. No. 8,186,360 to Marshall et al., the disclosures of which are incorporated herein by reference in their entireties.

As noted above, in various implementations, one or more of the substrate materials may have an aerosol precursor composition associated therewith. For example, in some implementations the aerosol precursor composition may comprise one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, a substrate material may produce a visible aerosol upon the application of sufficient heat thereto (and cooling with air, if necessary), and the substrate material may produce an aerosol that is "smoke-like." In other aspects, the substrate material may produce an aerosol that is substantially non-visible but is recognized as present by other characteristics, such as flavor or texture. Thus, the nature of the produced aerosol may be variable depending upon the specific components of the aerosol delivery component. The substrate material may be chemically simple relative to the chemical nature of the smoke produced by burning tobacco.

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. For example, some flavoring agents may be applied to, or incorporated within, the substrate material and/or those regions of the smoking article where an aerosol is generated. In some implementations, such agents may be supplied directly to a heating cavity or region proximate to the heat source or are provided with the substrate material. Example flavoring agents may include, for example, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, may also be suitable to be employed.

Flavoring agents may also include acidic or basic characteristics (e.g., organic acids, such as levulinic acid, succinic acid, pyruvic acid, and benzoic acid). In some implementations, flavoring agents may be combinable with the elements of the substrate material if desired. Example plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. Any of the materials, such as flavorings, casings, and the like that may be useful in combination with a tobacco material to affect sensory properties thereof, including organoleptic properties, such as described herein, may be combined with the substrate material. Organic acids particularly may be able to be incorporated into the substrate material to affect the flavor, sensation, or organoleptic properties of medicaments, such as nicotine, that may be able to be combined with the substrate material. For example, organic acids, such as levulinic acid, lactic acid, and pyruvic acid, may be included in the substrate material with nicotine in amounts up to being equimolar (based on total organic acid content) with the nicotine. Any combination of organic acids may be suitable. For example, in some implementations, the substrate material may include approximately 0.1 to about 0.5 moles of levulinic acid per one mole of nicotine, approximately 0.1 to about 0.5 moles of pyruvic acid per one mole of nicotine, approximately 0.1 to about 0.5 moles of lactic acid per one mole of nicotine, or combinations thereof, up to a concentration wherein the total amount of organic acid present is equimolar to the total amount of nicotine present in the substrate material. Various additional examples of organic acids employed to produce a substrate material are described in U.S. Pat. App. Pub. No. 2015/0344456 to Dull et al., which is incorporated herein by reference in its entirety.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In other implementations, the substrate material may include other materials having a variety of inherent characteristics or properties. For example, the substrate material may include a plasticized material or regenerated cellulose in the form of rayon. As another example, viscose (commercially available as VISIL®), which is a regenerated cellulose product incorporating silica, may be suitable. Some carbon fibers may include at least 95 percent carbon or more. Similarly, natural cellulose fibers such as cotton may be suitable, and may be infused or otherwise treated with silica, carbon, or metallic particles to enhance flame-retardant properties and minimize off-gassing, particularly of any undesirable off-gassing components that would have a negative impact on flavor (and especially minimizing the likelihood of any toxic off-gassing products). Cotton may be treatable with, for example, boric acid or various organophosphate compounds to provide desirable flame-retardant properties by dipping, spraying or other techniques known in the art. These fibers may also be treatable (coated, infused, or both by, e.g., dipping, spraying, or vapor-deposition) with organic or metallic nanoparticles to confer the desired property of flame-retardancy without undesirable off-gassing or melting-type behavior.

In the depicted implementation, the substrate material 116 may comprise a centrally defined longitudinally extending axis between the opposed first and second ends, and a cross-section of the substrate material 116 may be, in some implementations, symmetrical about the axis. For example, in some implementations a cross-section of the substrate material 116 may be substantially circular such that the substrate material 116 defines a substantially cylindrical shape extending between the opposed first and second ends thereof. However, in other implementations, the substrate material 116 may define a substantially non-circular cross-section such that the substrate material 116 may define a substantially non-cylindrical shape between the opposed first and second ends thereof. Otherwise, in other examples, the substrate material 116 may comprise an asymmetric cross-section about the axis. In various implementations, each end of the substrate material 116 may be in axial alignment with adjacent elements. For example, in some implementations a barrier may exist between the second end of the heat source 108 and the first end of the substrate material 116. In some implementations, such a barrier may comprise a disc that may include one or more apertures therethrough. In some implementations, the barrier may be constructed of a metal material (such as, for example, stainless steel, aluminum, brass, copper, silver, gold, and bronze), or a graphite material, or a ceramic material, or a plastic material, or any combinations thereof. In other implementations, a heat transfer component may exist between the heat source 108 and/or the substrate material 116. Examples of heat transfer components are described in U.S. patent application Ser. No. 15/923,735, filed on Mar. 16, 2018, and titled Smoking Article with Heat Transfer Component, which is incorporated herein by reference in its entirety.

As shown in FIGS. 2 and 3, the cartridge 102 of the depicted implementation also includes an outer housing 112 that is configured to circumscribe at least a portion of the substrate portion 110, including the substrate material 116. In the depicted implementation, the outer housing 112 is also configured to circumscribe at least a portion of the heat source 108. The outer housing 112 of the depicted implementation is constructed of an aluminum material; however, in other implementations the outer housing 112 may be constructed of other materials, including other metal materials (such as, for example, stainless steel, aluminum, brass, copper, silver, gold, and bronze), or graphite materials, or ceramic materials, or plastic materials, or any combinations thereof. In the depicted implementation, the outer housing 112 is constructed as tube structure that encapsulates the substrate material 116; however, as noted above, in other implementations the outer housing 112 may have other shapes. Although the shape of the outer housing 112 may vary, in the depicted implementation the outer housing 112 comprises a tube structure having an open end and a closed end. The depicted implementation of the outer housing 112 also includes one or more end apertures 118 located on the closed end of the outer housing 112 that are configured to allow aerosolized vapor (herein alternatively referred to as a "vapor" or "aerosol") to pass therethrough. The end apertures of the depicted implementation are in the form of a pair of elongate rounded slots; however, in other implementations the end apertures 118 may have any form that permits passage of the aerosol therethrough.

FIG. 4 illustrates a perspective view of the holder 104 of FIG. 1. As noted above, although in other implementations the holder 104 may have other shapes, the holder 104 of the depicted implementation includes a main body portion 120 and a mouthpiece 122, which together, at least in the depicted implementation, are configured to resemble the size, shape, and general appearance of a traditional cigarette. In particular, the main body portion 120 of the depicted implementation comprises a substantially cylindrical hollow tube. Likewise, the mouthpiece 122 of the depicted implementation comprises a substantially cylindrical hollow tube with an overall diameter that is larger than that of the main body portion 120. As will be discussed in more detail below, the mouthpiece 122 of the depicted implementation is configured to be moved (e.g., depressed) relative to the main body portion 120 in order to move the cartridge 102 relative to the holder 104 between received and ejected positions. For example, in the depicted implementation an internal diameter of the mouthpiece 122 may be slightly larger than, or substantially the same as, an outer diameter of the main body portion 120 in order to allow sliding movement between these components. It should be noted that in other implementations, the main body portion 120 and/or the mouthpiece 122 may have any other configuration. In the depicted implementation, the mouthpiece 122 has an overall length in an inclusive range of approximately 10 mm to 42 mm, the holder has an overall length in an inclusive range of approximately 83 mm to approximately 120 mm and a circumference in an inclusive range of approximately 20 mm to approximately 40 mm (e.g., a diameter in an inclusive range of approximately 6 mm to approximately 13 mm).

In various implementations, the main body portion 104 and/or the mouthpiece 122 may be constructed of a metal material (such as, for example, stainless steel, aluminum, brass, copper, silver, gold, and bronze), or a graphite material, or a ceramic material, or a plastic material, or any combinations thereof. Other materials are also possible. As depicted in the figure, the holder 104 of the depicted implementation also includes a plurality of end openings 124 that extend therethrough and are configured to align with at least a portion of the heat source 108 when the cartridge 102 is in the received position. In such a manner, the end openings 124 are configured to provide the heat source 108 with sufficient airflow to keep the heat source 108 ignited when in the received position. While in various implementations, such openings may have many different configurations (including, for example, slots and/or rings instead of, or in addition to, holes), in the depicted implementation the end openings comprise an alternating pattern of substantially circular holes that extend around a circumference of the receiving end of the holder 104. In particular, the alternating patterns of the depicted implementation include a first pattern 124*a* of four longitudinally spaced holes repeated at approximately 90° intervals around the circumference of the receiving end of the main body portion 120 of the holder 104, and a second pattern 124*b* of three longitudinally spaced holes also repeated at approximately 90° intervals, but shifted from the first pattern by approximately 45° around the circumference of the end of the main body portion 120.

FIGS. 5 and 6 illustrate various internal components of the holder 104 of FIG. 1. In particular, the holder 104 of the depicted implementation includes various internal components that together provide an ejection mechanism 126 configured to move between an ejected position and a received position, such as, for example, to receive and eject a cartridge 102. Although other implementations may differ (such as, for example, implementations wherein at least a portion of the cartridge extends from the holder in the received position), in the received position of the depicted implementation the cartridge 102 is substantially contained within the main body portion 120 of the holder 104. While in the ejected position of the depicted implementation, at least a portion of the cartridge 102 extends beyond the receiving end of the holder 104. Ejection mechanisms of various implementations may take a variety of forms, such as, for example, ejection mechanisms that eject a cartridge using a turning/screwing mechanism and/or a ratcheting mechanism. Other possible ejection mechanisms include mechanisms similar to those used in retractable click-pens, such as spring-loaded latch mechanisms and/or various spring-loaded cam mechanisms. The ejection mechanism 126 of the depicted implementation is configured to eject the cartridge using a click-in/click-out type cam mechanism. In particular, the ejection mechanism 126 of the depicted implementation includes a pusher pin 128, a retaining ring 129, a guide ring 130, a carrier sleeve 132, a spring 134, and a spring seat 136. Although in various implementations the components of the ejection mechanism may be made of a variety of different materials, in the depicted implementation the pusher pin 128, the carrier sleeve 132, the guide ring 130, and the retaining ring 129 are constructed of a molded plastic, such as, for example, acrylonitrile butadiene styrene (ABS), polyethylene, polycarbonate, Polyamide (Nylon), high impact polystyrene, polypropylene, and combinations thereof.

The spring seat 136 of the depicted implementation is located inside of and along the length of the main portion 120 of the holder 104 and is configured to remain fixed relative to the main body portion 120. In the depicted implementation, the spring seat 136 comprises a separate ring structure that is configured to be press fit into the inside of the main body portion 120 of the holder 104; however, in other implementations the spring seat 134 may be integral with the main body portion 120 and/or may comprise the same part. In the depicted implementation, the spring seat 134 is constructed of an aluminum material, while in other implementations the spring seat may be constructed of another material, including, other another metal material (such as, for example, stainless steel, brass, copper, silver, gold, and bronze), or a graphite material, or a ceramic material, or a plastic material, or any combinations thereof. Other materials are also possible.

Referring to FIG. 6, the carrier sleeve 132 of the depicted implementation includes a receiving cavity 138 and a vapor passageway 140. In the depicted implementation, the receiving cavity 138 is configured to receive an end of the cartridge 102 opposite the heat source 108 and retain the cartridge 102 therein during use. The vapor passage 140 of the carrier sleeve 132 is configured to allow aerosol produced by the substrate material 116 to pass through the carrier sleeve 132. As shown in the figures, a portion of the carrier sleeve 132 is configured to be located within an inside bore 142 of the pusher pin 128. In such a manner, the vapor passage 140 of the carrier sleeve 132 and the inside bore 142 of the pusher pin 128 are substantially co-linear so as to provide a path for the aerosol to travel after being aerosolized. In some implementations, at least a portion of the inside bore 142 of the pusher pin 128 may include a filter (not shown), such as, for example, proximate the user end of the mouthpiece 122. In various implementations, a filter may be included to filter the aerosol generated by the substrate material 116 before being inhaled by a user. In various implementations, such a filter may comprise a packed rod or cylindrical disc constructed of a gas permeable material (such as, for example, cellulose acetate or polylactic acid (PLA), polyvinyl alcohol (PVOH), or polypropylene fibers such as paper or rayon, or polyester fibers, or various combinations thereof). A filter may additionally or alternatively contain strands of tobacco containing material, such as described in U.S. Pat. No. 5,025,814 to Raker et al., which is incorporated herein by reference in its entirety. In various implementations the size and shape of the filter may vary.

In some implementations, the smoking article may also include an intermediate component between the substrate portion 110 and the filter 112. It should be noted that in various implementations, the intermediate component or the filter, individually or together, may be considered a filter of the smoking article. In various implementations, neither the intermediate component nor the filter need be included. In some implementations, the intermediate component may comprise a substantially rigid member that is substantially inflexible along its longitudinal axis. In some implementations, the intermediate component may comprise a hollow tube structure and may be included to provide for cooling the produced aerosol. In some implementations, the intermediate component may be used as a container for collecting the aerosol. In various implementations, such a tube may be constructed from any of a variety of materials and may include one or more adhesives. Example materials include, but are not limited to, paper, paper layers, paperboard, plastic, cardboard, and/or composite materials. In some implementations, the intermediate component may comprise a hollow cylindrical element constructed of a paper or plastic material (such as, for example, ethyl vinyl acetate (EVA), or other polymeric materials such as poly ethylene, polyester, silicone, etc. or ceramics (e.g., silicon carbide, alumina, etc.), or other acetate fibers), and the filter comprises a packed rod or cylindrical disc constructed of a gas permeable material (such as, for example, cellulose acetate or fibers such as paper or rayon, or polyester fibers).

In the depicted implementation, one end of the spring 134 of the ejection mechanism 126 is configured to contact the spring seat 136, and the other end of the spring 134 is configured to contact an end of the carrier sleeve 132. As will be discussed in more detail below, the carrier sleeve 132 is configured to move relative to the main body portion 120 of the holder 104 between the received position (pictured) and the ejected position. Because the spring seat 136 is affixed to the inside of the main body portion 120, in operation the carrier sleeve 132 is configured to further compress the spring 134 in a direction toward the receiving end of the holder 104 in order to reach the ejected position. In the depicted implementation, the spring 134 is installed in a semi-compressed state, and therefore the spring 134 is configured to bias the carrier sleeve 132 in a direction away from the spring seat 136. In particular, in the received position the spring 134 is configured to bias the carrier sleeve 132 against the guide ring 130, which, like the spring seat 136, is fixed relative to the main body portion 120 of the holder 104.

As noted above, the mouthpiece 122 of the depicted implementation is configured to move relative to the main body portion 120 when actuated by a user. Also, the pusher pin 128 of the depicted implementation is configured to be affixed to the mouthpiece 122 in such a manner that the pusher pin 128 does not move relative to the mouthpiece 122. As such, the mouthpiece 122 and the pusher pin 128 of the depicted implementation are configured to move together relative to the main body portion 120 of the holder 104. For example, in the depicted implementation the mouthpiece 122 is press-fitted onto an end of the pusher pin 128; however, in other implementations these parts may be affixed in other ways, including by way of adhesives and/or ultrasonically welding. In still other implementations, the mouthpiece 122 and the pusher pin 128 may be integral and/or may comprise the same part. As will be discussed in more detail below, the mouthpiece 122 and pusher pin 128 are configured to move the carrier sleeve 132 such that the carrier sleeve 132 (and inserted cartridge 102) alternates between the received position and the ejected position.

FIG. 7 illustrates perspective views of various components of the ejection mechanism 126 of FIG. 6. In particular, FIG. 7 illustrates the spring seat 136, spring 134, carrier sleeve 132, guide ring 130, pusher pin 128, and retaining ring 129. The carrier sleeve 132 of the depicted implementation includes a first tube portion 144 and second tube portion 146 that extends from the first tube portion 144. In the depicted implementation, the second tube portion 146 has an outer diameter that is smaller than an outer diameter of the first tube portion 144. In addition, the carrier sleeve 132 includes four longitudinal fins 148 that are substantially equally spaced around a circumference of the second tube portion 146. Each of the fins 148 of the depicted implementation includes an angled end 150. The guide ring 130 of the depicted implementation includes eight internal grooves 152 that extend from a first end thereof, and four angled stops 154 on an opposite end of the guide ring 130. The pusher pin 128 includes a main portion 156 that comprises a substantially cylindrical tube shape. A stop flange 158 having a ring shape is defined along the length of the main portion 156. The main portion 156 also includes eight protruding guide features 160 that are substantially equally spaced around a circumference of the main portion 156 and are configured to slide within the internal grooves 152 of the guide ring 130. An end of the main portion 156 includes a series of angled teeth 162. The stop flange 158 of the pusher pin 128 is positioned on the spring side of the retaining ring 129, which as noted above, is fixed in relation to the mouthpiece 122. An inner diameter of the retaining ring 129 and an outer diameter of the main portion 156 of the pusher pin 128 are configured such that the main portion 156 of the pusher pin 128 can slide within the retaining ring 129. In some implementations, the retaining ring may serve as a stop for the stop flange 158 of the pusher pin 128.

Referring also to FIGS. 5 and 6, in operation the angled teeth 162 of the pusher pin 128 are configured to engage respective angled ends 150 of the longitudinal fins 148 of the carrier sleeve 132 to move the carrier sleeve 132 to the ejected position. In particular, starting from the received position (shown in FIGS. 5 and 6) in which the first tube portion 144 of the carrier sleeve 132 abuts the guide ring 130 and the longitudinal fins 148 of the carrier sleeve 132 and the guide features 160 of the pusher pin 128 are located within the internal grooves 152 of the guide ring 130, a user may effect the ejected position by pressing the mouthpiece 122 toward the receiving end of the holder 104. Because the pusher pin 128 is affixed to the mouthpiece 122 and the guide ring 130 is affixed to the main body portion 120 of the holder 104, this action moves the guide features 160 of the pusher pin 128 within the internal grooves 152 of the guide ring 130 while the teeth 162 of the pusher pin 128 push the longitudinal fins 148 of the carrier sleeve 132 within the internal grooves 152 of the guide ring 130 in the longitudinal direction of the receiving end of the holder 104. Because the spring 134 is confined between an end of the carrier sleeve 132 and the spring seat 136 (which is affixed to the main body portion 120 of the holder 104), this movement is resisted by a spring force generated by the spring 134.

Due to the geometry and spacing of the components, the guide features 160 of the pusher pin 128 remain inside of the internal grooves 152 of the guide ring 130 when moving between the received position and the ejected position; however, the longitudinal fins 148 of the carrier sleeve 132 are configured to temporarily disengage from the internal grooves 152 of the guide ring 130 such that the carrier sleeve 132 rotates a portion of a turn when moved between the received position and the ejected position (and vice versa). In particular, when the carrier sleeve 132 is moved by the pusher pin 128 from the received position, the longitudinal fins 148 slide within the internal grooves 152 of the guide ring 130 until the angled ends 150 of the longitudinal fins 148 move past the ends of the internal grooves 152, at which point the angled ends 150 slide along the surfaces of the angled stops 154, and the carrier sleeve 132 begins to rotate and move a short distance in an opposite longitudinal direction (e.g., away from the receiving end of the holder 104). Due to the force applied by the spring 134 on the end of the carrier sleeve 132, the angled ends 150 of the longitudinal fins 148 continue to slide along the surfaces of the angled stops 154 (and the carrier sleeve 132 continues to rotate) until the angled ends 150 of the longitudinal fins 148 fully locate within respective angled stops 154 of the guide ring 130, wherein the carrier sleeve 132 stops rotating. This position represents the ejected position, wherein the spring 134 is further compressed from its initial compression at the received position, and wherein (when a cartridge 102 is received into the first tube portion 144 of the carrier sleeve 132) the end of the cartridge 102 having the heat source 108 extends beyond the receiving end of the holder 104. Due to the geometry of the angled stops 154 of the guide ring 130, the ejection mechanism 126 is configured such that it will remain in the ejected position until the user pushes the mouthpiece 122 again to move to the received position. Likewise, once in the received position, the ejection mechanism 126 is configured to remain in the received position until the user pushes the mouthpiece 122 to move to the ejected position.

Starting from the ejected position, in which the angled ends 150 of the longitudinal fins 148 are fully located within angled stops 154 of the guide ring 130, a user may move the ejection mechanism 126 from the ejected position to the received position by pressing the mouthpiece 122 toward the receiving end of the holder 104. This causes the pusher pin 128 to move the angled ends 150 of the longitudinal fins 148 a short distance toward the receiving end of the holder 104 and out of complete engagement with the angled stops 152 of the guide ring 130. In particular, when the carrier sleeve 132 is moved from the ejected position, the longitudinal fins 148 first slide toward the receiving end of the holder 104 until the angled ends 150 of the longitudinal fins 148 move past the ends of the angled stops 154, at which point the longitudinal fins 148 temporarily disengage from the internal grooves 152 of the guide ring 130 and the carrier sleeve 132 begins to rotate. As the carrier sleeve 132 rotates, the carrier sleeve 132 begins to move in the opposite longitudinal direction (e.g., away from the receiving end of the holder 104) and the angled ends 150 of the longitudinal fins 148 slide into an adjoining set of internal grooves 152 of the guide ring 130. The longitudinal fins 148 then continue to slide in the internal grooves 152 in the direction away from the receiving end of the holder 104 until the first tube portion 144 of the carrier sleeve 132 abuts the guide ring 130. At this point, the ejection mechanism is back in the received position. It should be noted that in the received position of some implementations, the stop flange 158 may alternatively or additionally abut the retaining ring 129. In still other implementations, other features may serve as stopping features for the received position and/or the ejected position.

FIG. 8 illustrates a perspective view of the smoking article 100, with the removable cartridge 102 received into the holder 104 in the received position, and FIG. 9 illustrates a longitudinal cross-section view of the smoking article 100 of FIG. 8. In various implementations the carrier sleeve 132 and/or the cartridge 102 may include one or more retaining features configured to retain the cartridge 102 in the carrier sleeve 132 once inserted. For example, in the depicted implementation the cartridge 102 includes one or more protrusions 164 configured to interface with a portion of the receiving cavity 138 of the carrier sleeve 132 such that an interference fit or some other type of "holding" fit is created. In various implementations, such a fit may allow the cartridge 102 to be retained in the carrier sleeve 132 once inserted, while also allowing the cartridge 102 to be removed upon application of sufficient removal force, such as, for example, that exerted by a user attempting to pull the cartridge 102 out of carrier sleeve 132. In some implementations, the carrier sleeve 132, or a portion thereof, may include complementary features, such as, for example, one or more indents or recesses into which the protrusions 164 may locate. It should be noted that in other implementations, other types of retaining methods may be used, including, for example, one or more magnets located in the cartridge 102 and/or the carrier sleeve 132 (or one or more other components of the holder 104). Other implementations may include a retaining feature that extends from or is otherwise activated to cover the receiving end of the holder 104. For example, a retaining feature may be used to retain the cartridge 102 in the holder 104 once inserted in the receiving end thereof. In some implementations, such a retaining feature may comprise a mesh or screen structure constructed of a metal material. For example, in some implementations the retaining feature may be activated by a user to retain a cartridge 102 inserted into a holder 104 when it is moved from the ejected position to the received position.

FIG. 10 illustrates a perspective view of the smoking article 100, showing the cartridge 102 in both the received and ejected positions. In various implementations, the ejected position may be helpful, for example, for igniting the heat source 108 of the cartridge 102, and the received position may be helpful, for example, for protecting an ignited heat source 108 from contact. In addition, in various implementations the ejected position may be helpful for removing the cartridge 102 from the carrier sleeve 132 of the holder 104 and/or for receiving the cartridge 102 into the carrier sleeve 132 of the holder 104. It should be noted that although in the ejected position of the depicted implementation the cartridge 102 is positioned at or slightly past a point at which the entire heat source 108 extends beyond the receiving end of the holder 104, in the ejected position of other implementations the cartridge 102 may extend to a different location relative to the holder 104, such as, for example, a position wherein a majority of the heat source 108 extends beyond the receiving end of the holder 104, or a position wherein only a portion of the heat source 108 extends beyond the receiving end of the holder 104. It should be noted that in further implementations, there may be more than one ejected position. For example, some implementations may include a first ejected position, as described above, and a second ejected position, in which the cartridge may extend farther beyond the receiving end of the holder 104. In such a manner, a second ejected position may provide additional access to the cartridge 102 for removal and/or insertion within the holder 104. Additional implementations may include an infinite number of other ejected positions, which may comprise any location between the received position and a position in which the cartridge 102 is fully outside of the holder 104.

Some implementations may include a heat source extinguishment mechanism, which may be activated by a user or may be automatic. In one example, the ejection mechanism of the smoking article may include a third position that retracts the cartridge 102 farther into the holder 104. In such a manner, the heat source 108 may be moved away from the receiving end and openings 124 of the holder 104 such that the receiving end and openings 124 no longer provide sufficient airflow to keep the heat source 108 ignited, therein effectively extinguishing the heat source 108. In other implementations, the holder 104 may include an outer (or inner) sleeve that is configured to slide over the end openings 124 of the holder 104 (and, in some implementations, the receiving end) so as to restrict or block airflow to the heat source 108. It should be noted that other extinguishment mechanisms are possible, such as other implementations wherein the heat source 108 is starved of oxygen in order to effectively extinguish the heat source 108. While in some implementations activation of the extinguishment mechanism may occur via the mouthpiece 122 or another component and/or may be integrated with the ejection mechanism, in other implementations, other activation methods, including independent extinguishment mechanisms, are possible.

Some implementations may include an igniting mechanism, which may be activated by a user or may be automatic. In one example, the igniting mechanism may include an integrated flint lighter that may be independently activated by a user, or may be automatically activated when the ejection mechanism is activated. Other implementations may include a fuel source, such as a fuel tank, that, in conjunction with an ignitor, may produce a flame that ignites the heat source 108. In various implementations, activation of the igniting mechanism may occur via the mouthpiece 122 or another component and/or may be integrated with the ejection mechanism.

In some implementations, the smoking article 100 may further include an indicator configured to indicate a status of the cartridge 102. For example, in some implementations the indicator may provide a "fuel gage" that approximates how much substrate material in the cartridge may be available for aerosolization and/or how much substrate material has already been aerosolized. Another example of such an indicator may include thermochromatic visual indication of the substrate portion through its consumption cycle. Other examples may include a timer, clock, or progressive visual indicator that provides visual representation of the state of the substrate material. For example, some implementations may provide visual representation in the way of digital indicators, one or more components that change color, one or more lights (e.g., green, yellow, and red), or other progressive indicators. In some implementations, an indicator may provide indication to a user that the substrate portion has heated sufficiently for the user to begin smoking.

Although a smoking article according to the disclosure may take on a variety of implementations, as discussed in detail herein, the use of the smoking article by a consumer will be similar in scope. The foregoing description of use of the smoking article is applicable to the various implementations described through minor modifications, which are apparent to the person of skill in the art in light of the further disclosure provided herein. The description of use, however, is not intended to limit the use of the inventive article but is provided to comply with all necessary requirements of disclosure herein.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A smoking article comprising:

a holder that includes a receiving end and a mouth end;

a removable cartridge configured to be received into the receiving end of the holder, the removable cartridge comprising a heat source configured to generate heat upon ignition thereof, and a substrate portion having opposed first and second ends, the heat source being disposed proximate the first end of the substrate portion, and the substrate portion including a substrate material having an aerosol precursor composition associated therewith; and an ejection mechanism configured to move the cartridge relative to the holder between a received position and an ejected position, the ejection mechanism including a carrier sleeve, wherein the holder comprises a main body portion and a mouthpiece at the mouth end of the holder, wherein the mouthpiece is configured to move relative to the main body portion, wherein in the ejected position, the mouthpiece is depressed over the main body portion toward the receiving end thereof, wherein the carrier sleeve comprises a receiving cavity configured to receive an end of the removable cartridge, and wherein actuation of the mouthpiece causes the carrier sleeve to move relative to the main body portion between the received position and the ejected position.

2. The smoking article of claim 1, wherein the cartridge further comprises an outer housing configured to circumscribe at least a portion of the substrate portion.

3. The smoking article of claim 2, wherein the outer housing includes one or more end apertures configured to allow aerosol from the substrate material to pass therethrough.

4. The smoking article of claim 1, wherein the ejection mechanism comprises a pusher pin, a guide ring, the carrier sleeve, and a spring, wherein the pusher pin is configured to move the carrier sleeve relative to the guide ring so as to actuate the carrier sleeve alternately between the received position and the ejected position.

5. The smoking article of claim 4, wherein the carrier sleeve includes a vapor passageway and the pusher pin includes an inside bore, and wherein the vapor passageway and the inside bore are configured to provide a path for aerosol from the substrate material to pass therethrough.

6. The smoking article of claim 1, wherein the substrate material comprises at least one of tobacco-containing beads, tobacco shreds, tobacco strips, pieces of a reconstituted tobacco material, tobacco rods, and non-tobacco materials.

7. The smoking article of claim 1, wherein the substrate material comprises a non-tobacco material.

8. The smoking article of claim 1, wherein the heat source comprises an extruded monolithic carbonaceous material.

9. The smoking article of claim 1, wherein the heat source defines one or more passages extending longitudinally from a first end of the heat source to an opposing second end of the heat source.

10. The smoking article of claim 1, wherein the heat source defines one or more peripheral grooves extending longitudinally from a first end of the heat source to an opposing second end of the heat source.

11. The smoking article of the claim 1, wherein the holder includes a plurality of openings located proximate the receiving end.

12. The smoking article of claim 1, wherein the holder is constructed of at least one of a ceramic material, a plastic material, and a metal material.

13. The smoking article of claim 1, wherein the holder includes a thermal indicator configured to indicate a status of the cartridge.

14. The smoking article of claim 1, wherein the substrate material comprises first and second substrate material segments and wherein the second substrate material segment is disposed proximate a second end of the first substrate material segment.

15. The smoking article of claim 14, wherein the second substrate material segment comprises at least one of tobacco-containing beads, tobacco shreds, tobacco strips, pieces of a reconstituted tobacco material, or tobacco rods.

16. The smoking article of claim 14, wherein the second substrate material segment comprises a non-tobacco material.

17. The smoking article of claim 1, wherein the mouthpiece includes a filter.

18. The smoking article of claim 1, wherein the cartridge includes one or more retaining features configured to retain the cartridge once inserted into the holder.

19. The smoking article of claim 18, wherein the holder includes one or more retaining features configured to engage respectively with the one or more retaining features of the cartridge.

* * * * *